US005413349A

United States Patent [19]

Canther

[11] Patent Number: 5,413,349

[45] Date of Patent: May 9, 1995

[54] SCENIC GOLF GAME

[76] Inventor: David M. Canther, 2051 E. Imperial Cir., Naples, Fla. 33942

[21] Appl. No.: 291,680

[22] Filed: Aug. 16, 1994

[51] Int. Cl.[6] ..... A63F 3/00
[52] U.S. Cl. ..... 273/245
[58] Field of Search ..... 273/244, 245, 259

[56] References Cited

U.S. PATENT DOCUMENTS

| | | | |
|---|---|---|---|
| 1,334,176 | 3/1920 | Seagrave | 273/245 |
| 3,260,526 | 7/1966 | Seitz | 273/245 |
| 3,410,561 | 11/1968 | Ekstrand | 273/245 |
| 4,113,260 | 9/1978 | Sain | 273/245 |
| 4,277,065 | 7/1981 | White | 273/245 |
| 5,000,460 | 3/1991 | Barbiaux et al. | 273/245 |
| 5,234,218 | 8/1993 | La Rocca | 273/245 |

FOREIGN PATENT DOCUMENTS

| | | | |
|---|---|---|---|
| 1334524 | 10/1973 | United Kingdom | 273/245 |
| 2135200 | 8/1984 | United Kingdom | 273/245 |
| 2151145 | 7/1985 | United Kingdom | 273/245 |

*Primary Examiner*—William E. Stoll
*Attorney, Agent, or Firm*—William F. Hamrock

[57] ABSTRACT

A golf game apparatus having a plurality of game boards representing different golf hole playing areas set within different scenic settings. A grid pattern having intersecting longitudinal and transverse straight lines forming quadrilateral blocks gradually changing in size relative to the perspective distance encompasses the playing areas and provides the playing surface. A plurality of playing pieces move on the playing surface subject to chance devices including combinations of dice having numerical indicia, dice having weather conditions indicia and playing cards affecting the club and direction of the hit.

19 Claims, 12 Drawing Sheets

FIG. 15

"PRO SKILL"
No Headwind
(unless desired)

"PRO SKILL"
No Wind Right
(unless desired)

"PRO SKILL"
No Tailwind
(unless desired)

"PRO SKILL"
No Sandtrap Penalty

"PRO SKILL"
No Wind Left
(unless desired)

"PRO SKILL"
No Water or Rock Penalty

"STANCE CORRECTION RIGHT"
Move two spaces Right

"STANCE CORRECTION LEFT"
Move two spaces Left

"IRON DRIVER CLUB"
Add or Subtract two spaces if before "tree markers" or off "tee"

"MULLIGAN"
Cancel first roll
*Use second roll and draw again

"HOOK"
Add three spaces diagonally at end of play to the left
*If play begins before the "Green"

"BREAK"
Add one space diagonally at end of play

"CLOSED CLUBFACE"
Move one space Left

"PUTTER"
Add or Subtract up to two spaces to play
(no diagonal)
*If play begins on the "Green"

"OPEN CLUBFACE"
Move one space Right

"WOOD DRIVER CLUB"
Add two spaces if before "tree markers" or off "tee"

"SLICE"
Add three spaces diagonally at end of play to the Right
*If play begins before the "Green"

"CHIPPING IRON CLUB"
Add or Subtract one space
*If play begins before the "Green"

SCENIC GOLF GAME

BACKGROUND OF THE INVENTION

1. Field of the Invention

This invention relates to a golf board game and, more particularly, it concerns a golf board game in which the playing area for each hole is set within a different elaborate picturesque scenic setting wherein the game of golf is not played and wherein combinations of chance devices are used to simulate actual playing conditions.

2. Description of the Prior Art

Various simulated golf games are known to have a variety of different chance devices to enhance the playing. Many of these games concentrate on the use of the chance devices and deal very little with the actual playing characteristics involved in golf. Also, the playing area of many of these games fail to stimulate the imagination and interest of the players. As a result, very few simulated golf games hold the interest of the game players.

SUMMARY OF THE PRESENT INVENTION

In accordance with the present invention, a golf game is provided for playing on a flat game board in picturesque settings wherein such settings the actual game of golf in reality cannot be played. All other simulated golf games of the prior art are set within the confines of a conventional golf course settings where the real game of golf is played. The present board game is an entirely different game. Each playing hole encompasses a large picturesque setting which introduces a uniquely different playing area and uniquely different obstacles to overcome in playing.

The present game provides a number of playing areas, presently representing nine holes of golf, including the tees, a designated fairway and green for each hole. Each playing area is set within a different elaborate geographic scenic setting depicting an actual world renowned picturesque scene which is placed on a flat surface. None of these scenes relates to a golf course but is an unrelated scene of some picturesque setting. Each of the present nine scene holes of the invention presently represent a scenic view of a unique golf playing area set within the following scenes: on a majestic meadow, a view from a mountain, in a dry river gulch, on a waterfront island, on a rainbow encompassed ravine, on a misty morning engulfed prairie, on a lakeside low land, atop a mountainous cliff and within snow capped mountains.

A perspective grid pattern which coincides with the dimensions and the visualization of the scenic setting overlaps the playing area. The perspective grid provides the playing surface upon which the game is to be played since otherwise the game could not be played on these non-golf course settings.

It is known to use grids of equally spaced vertical and horizontal lines forming squares in Simulated golf games to mark the distance of the playing piece in the playing area. However, the present grid is a perspective grid pattern which coincides with the picturesque setting and provides a surface upon which the playing piece can be played in the non-golf elaborate scenic setting. It allows the playing pieces of the invention to be played on all types of settings and lies not previously encountered in golf games such as in a dry river gulch, in snow capped mountains, on mountain cliffs and all types of scenic backgrounds. The perspective grid pattern is composed of longitudinal and transverse lines which form various quadrilateral blocks gradually changing in size by conforming to the size and visualization of the playing area, the overlapping scenic setting and the horizon. Also, each block designates a numerical position for movement of the playing pieces from the tees to the greens within the quadrilateral blocks and acts as a reference for locating points on the playing surface. The numerical distance within the blocks to the green varies for each hole so that for the nine holes here there are five par four holes, two par three holes and two par five holes.

The present game can be played with as many players as desired but preferably with up to five individual players or five teams of players. Each player or team is represented by a golf tee-shaped playing piece which designates the location and position of the ball within a block having a certain lie on the grid on the playing surface. A first combination of numbered dice and a unique die designating various weather conditions is played to determine the various locations and lies of the ball or playing piece on the fairway. A second combination of a uniquely numbered die and a die designating playing conditions is played to determine the various locations and lies of the ball or playing piece on the green. With each of the first and second combinations of dice, a chance card is also played which affects the direction of the ball after being hit.

The principle object of the present invention is the provision of a golf board game which can be played in entirely different picturesque scenic settings not encountered in any other golf game.

Another object is the provision of the golf board game's picturesque setting being such that in reality the picturesque setting does not allow the actual game of golf to be played therein.

A further object of the present invention is the provision of combinations of chance devices which simulate actual playing conditions encountered while playing golf.

Another further object is the provision Of a golf board game which can be played by a number of players and will be challenging to the players.

Another further object is the provision Of an elaborate picturesque scenic setting for the playing area of each hole which will not only stimulate the interests but will also hold the interests of the players.

Another further object is the provision of a golf board game wherein each hole characterizes a unique amusement golf game.

Other objects and further scope of applicability of the present invention will become apparent from the following detailed description taken in conjunction with the accompanying drawings.

BRIEF DESCRIPTION OF THE DRAWING

FIG. 15 is a view of Skill Cards and Pro Skill Cards.

DESCRIPTION OF THE PREFERRED EMBODIMENT

The golf game herein disclosed is not merely another golf game of chance but is designed substantially to present a very stimulating and imaginative golf game not previously available. The present invention brings indoors nine holes of golf set within nine of the most beautiful scenes in the world for enjoyment and challenge.

Figure 1:
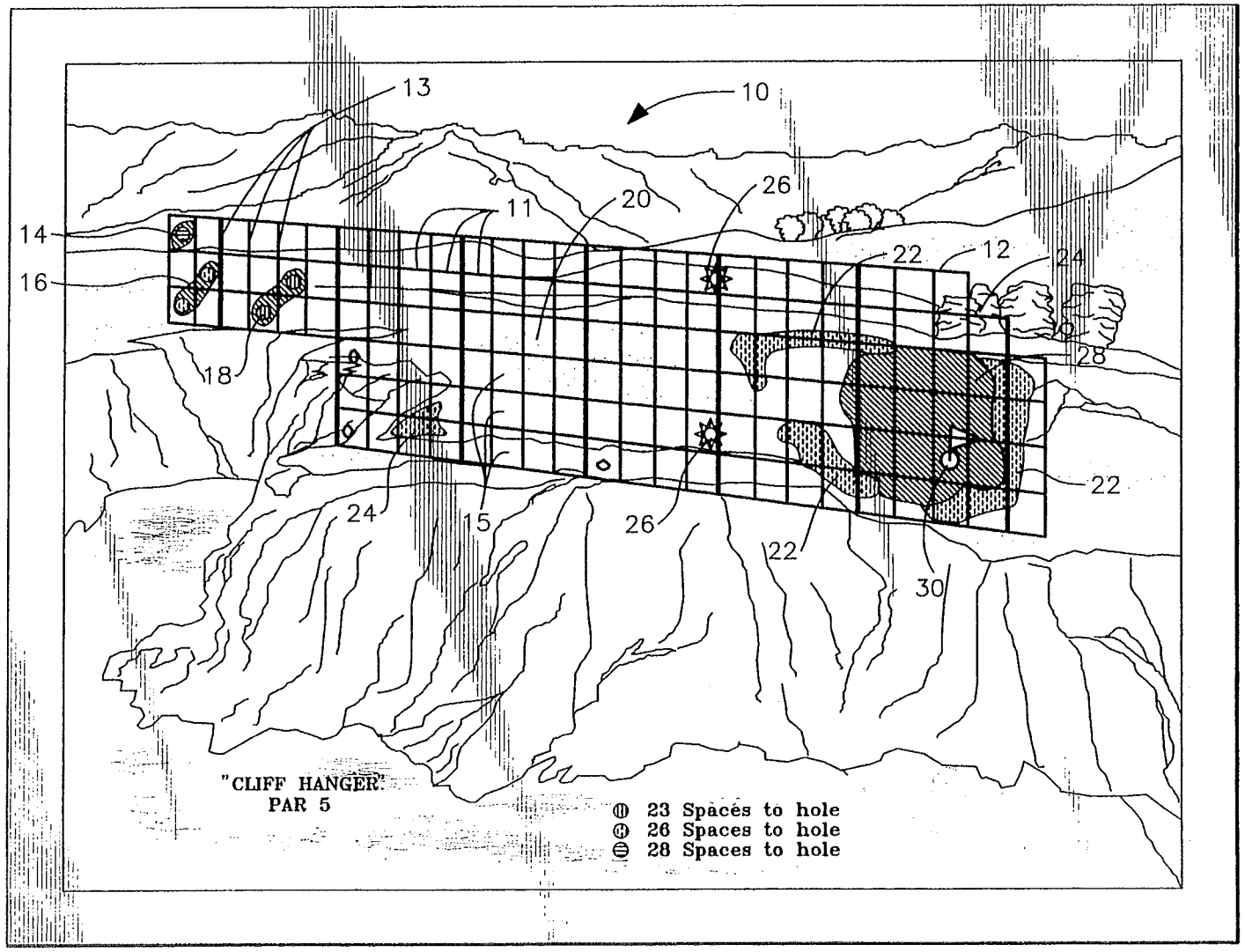
FIG. 1 illustrates a perspective view of a "Cliff Hangar" par 5 hole.

In FIGS. 1–9 of the drawings, there are depicted the nine scenic holes of golf of the invention. In FIG. 1, the par 5 "Cliff Hangar" scene 10 which depicts the playing area set on a cliff plateau is shown with the perspective grid pattern 12 encompassing the playing area. The grid pattern forms quadrilateral blocks 15 by longitudinal lines 11 and transverse lines 13. Shown are three tee off positions including professional tee position 14, normal tee position 16 and advantage tee position 18, the fairway 20, sand traps 22, hedges 24, markers 26, green 28 and hole 30. The blocks in the perspective grid pattern 12 gradually increase in size from the tee positions towards the green. The specially placed markers 26 in this hole and in all the holes designate three fourths of the distance to the green which require that only a chip iron can be used thereafter. The area outside the grid 12 in this hole and all the holes indicates out of bounds.

Figure 2:
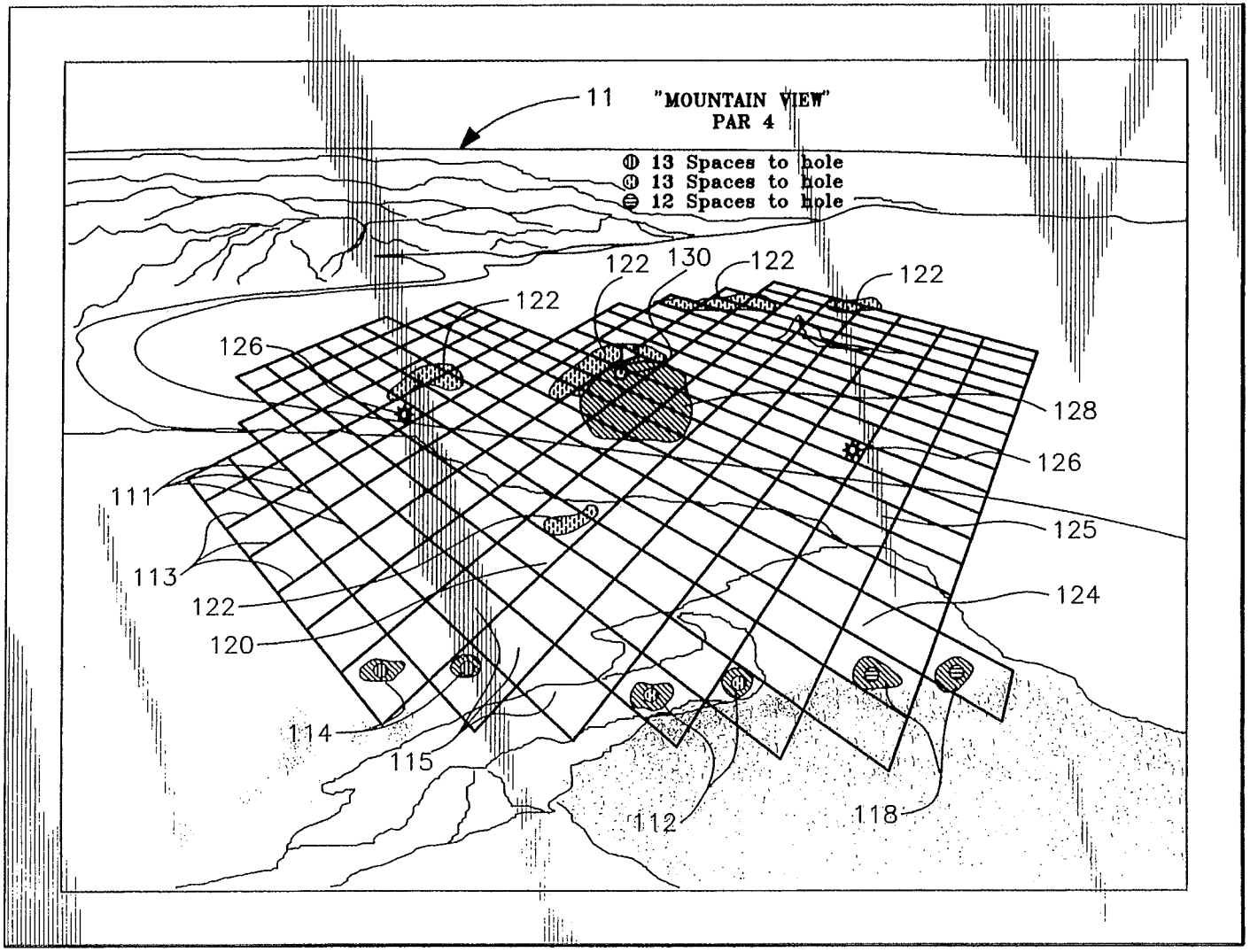
FIG. 2 illustrates a perspective view of a "Mountain View" par 4 hole.

In FIG. 2, the par 4 "Mountain View" scene 11 is shown which depicts the playing area viewed from a mountain with the perspective grid pattern 112 and professional tee position 114, normal tee position 116 and advantage tee position 118. The grid pattern forms quadrilateral blocks 115 by longitudinal lines 211 and transverse lines 213. The professional and normal tees position are set on top of the mountain which is above the advantage tee position which is set on a plain in the lower playing area. The blocks in the perspective grid pattern 112 gradually decrease in size from the tee positions towards the green. Shown on the fairway 120, are sand traps 122, trees and shrubbery 124, and markers 126, and on green 128 the hole 130.

Figure 3:
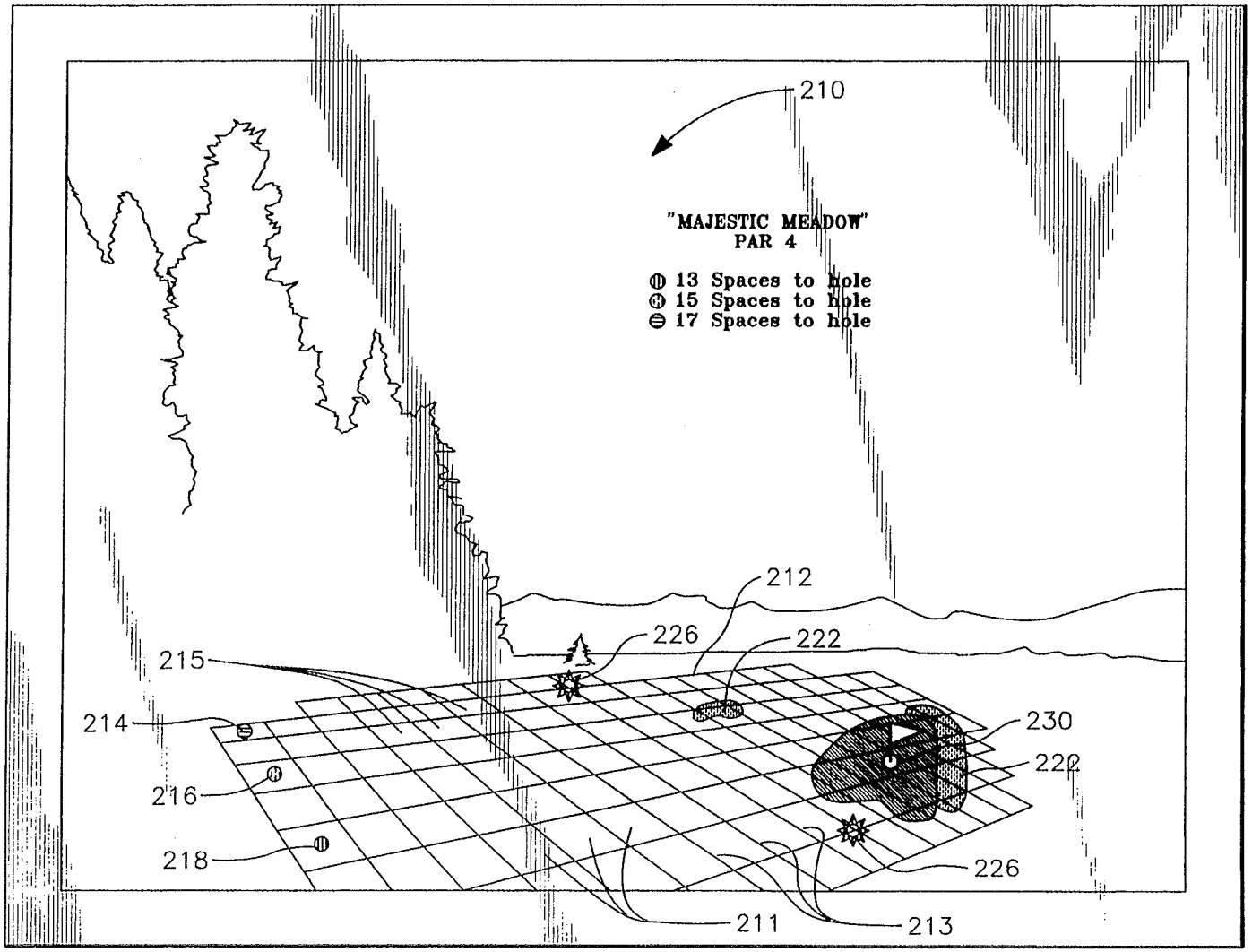
FIG. 3 illustrates a perspective view of a "Majestic Meadow" par 4 hole.

In FIG. 3, the par 4 "Majestic Meadow" scene 210 which depicts the playing area set within a flowering meadow is shown with the perspective grid pattern 212, the grid pattern forms quadrilateral blocks 315 by longitudinal lines 211 and transverse lines 313 the professional tee position 214, normal tee position 216 and advantage tee position 218 set within the playing area. The blocks of the perspective grid pattern 212 do not change in size because of being close by from directly above in a small playing area. Shown set within the playing area of the perspective grid pattern are the fairway 220, sand traps 222, trees 224, markers 226, green 228 and hole 230.

Figure 4:
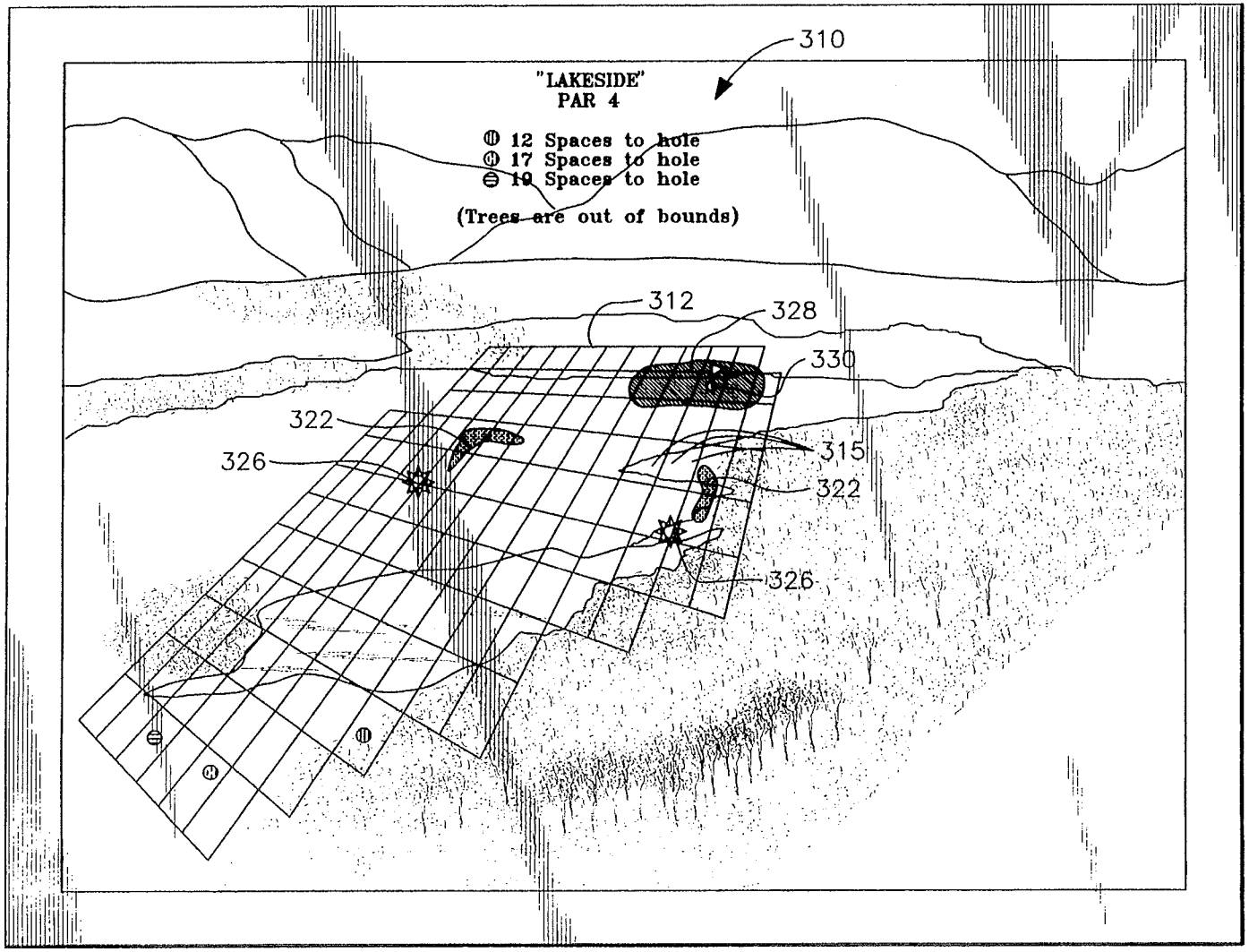
FIG. 4 illustrates a perspective view of a "Lakeside" par 4 hole.

Shown in FIG. 4 is the par 4 "Lakeside" scene 310 which depicts the playing area set in a low land pasture bordering a lake and surrounded by forest as viewed from above. The perspective grid 312 pattern is shown overlapping part of the lake and forest. The grid pattern forms quadrilateral blocks 415 by longitudinal lines 411 and transverse lines 413. Shown are the professional tee position 314, normal tee position 316 and advantage tee position 318, fairway 320, sand traps 322, lake and forest 324, markers 326, green 328 and hole 330. The blocks of the perspective grid pattern 312 gradually increase in size from the tee positions towards the green.

Figure 5:
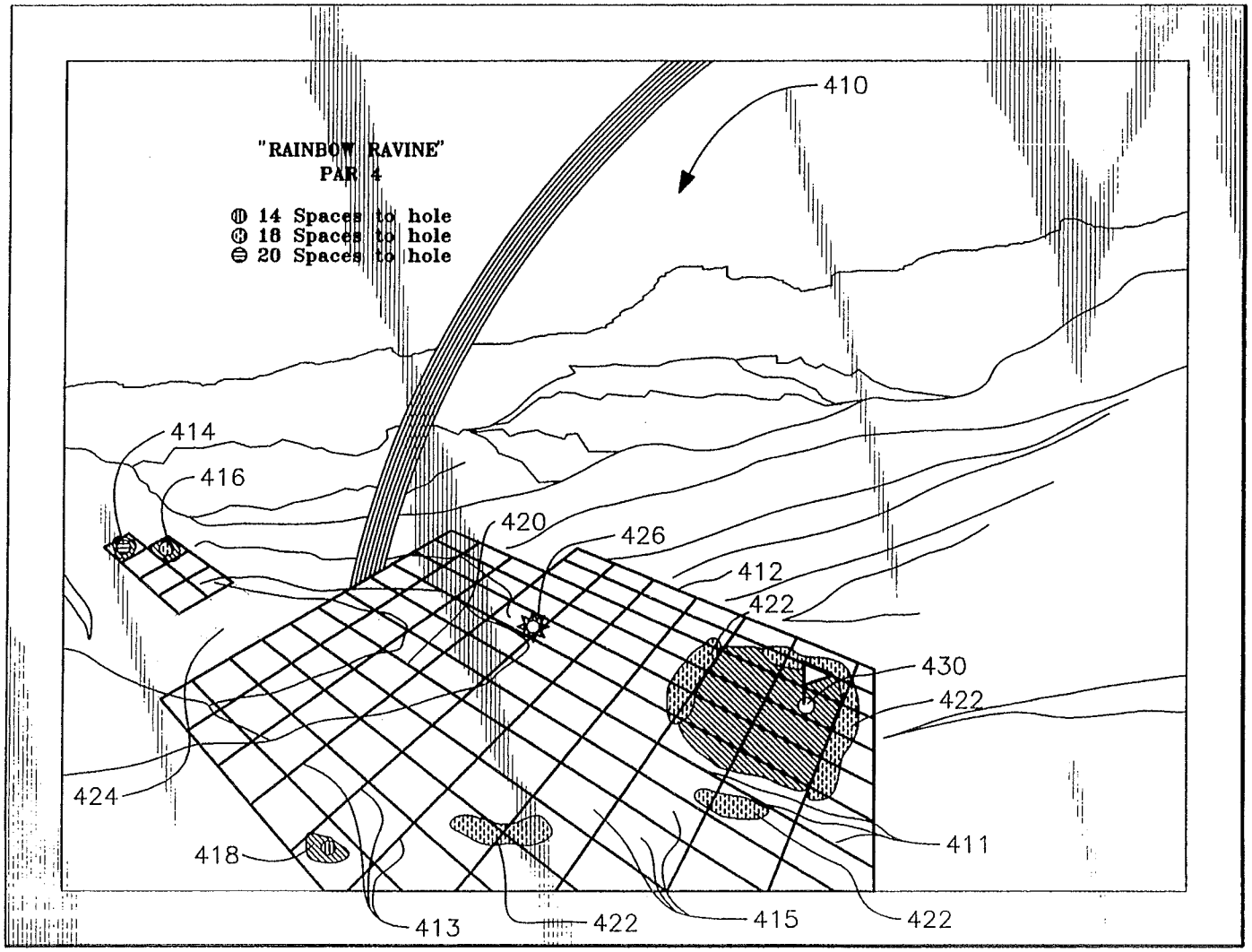
FIG. 5 illustrates a perspective view of a "Rainbow Ravine" par 4 hole.

In FIG. 5, the par 4 "Rainbow Ravine" scene 410 depicts the playing area set within a rainbow shaded ravine at the foot of a mountain and having a river flowing therethrough. The perspective grid 412 pattern overlaps an interior mountain showing professional tee position 414 and normal tee position 416 set thereon with advantage tee position 418 set on top of an opposite elevation across the river. The blocks of the perspective grid pattern 412 gradually increase in size from the professional and normal tee positions towards the green. The grid pattern forms quadrilateral blocks 515 by longitudinal lines 511 and transverse lines 513. Shown on fairway 420 are sand traps 422, trees and shrubbery 424, markers 426, green 428 and hole 430.

Figure 6:
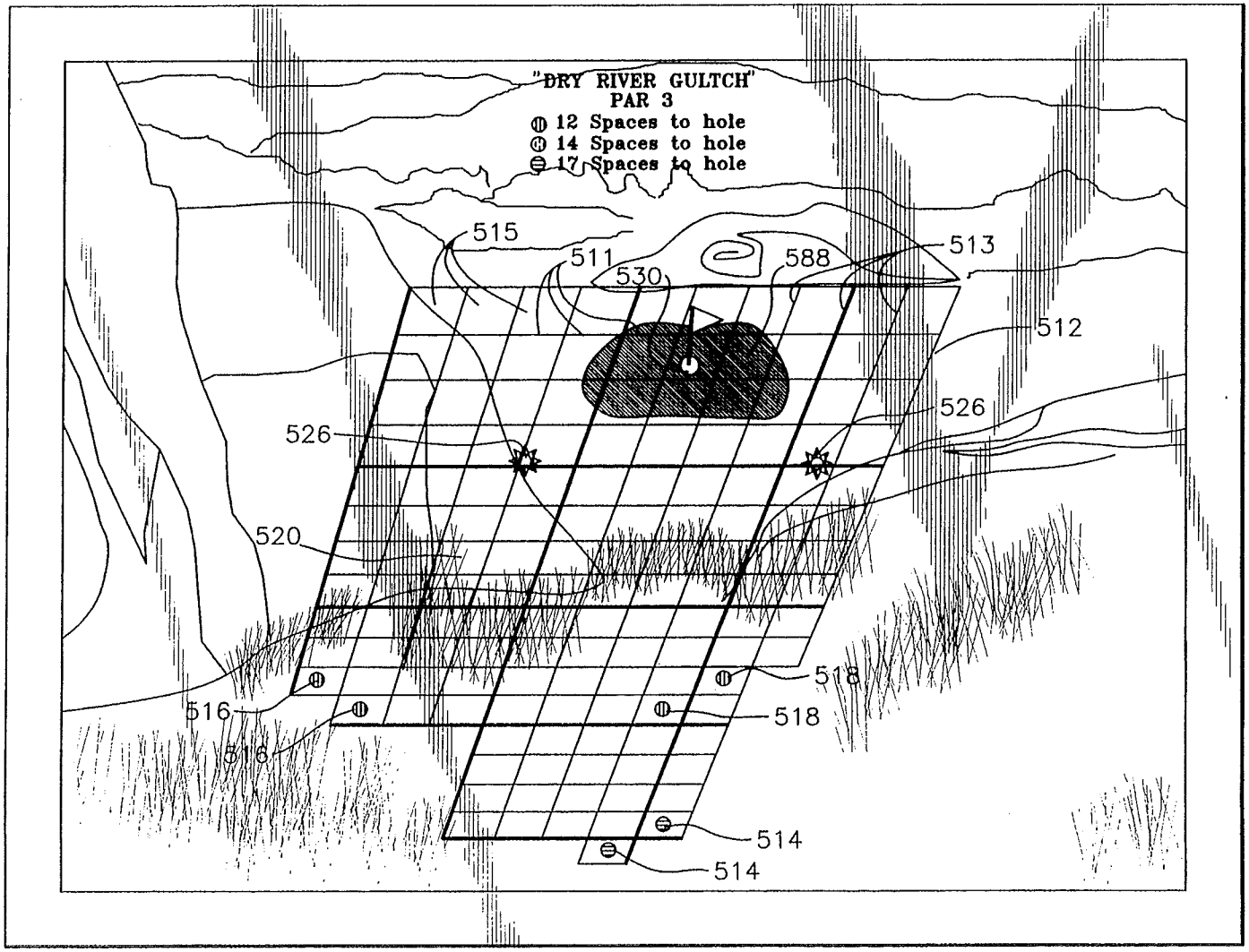
FIG. 6 illustrates a perspective view of a "Dry River Gulch" par 3 hole.

In FIG. 6, the par 3 "Dry River Gulch" scene depicts the playing area of a small dry river based canyon set within steep mountainous slopes and large rock formations. The perspective grid pattern 512 is shown overlapping the mountainous slopes and rock formations and the dry river based canyon and encompassing the green. The grid pattern forms quadrilateral blocks 515 by longitudinal lines 511 and transverse lines 513. The professional tee position 514, normal tee position 516 and advantage tee position 518 are shown in the dry river based canyon. The blocks of the perspective grid pattern 512 gradually increase in size from the tee positions towards the green. Shown are the fairway 520 encompassing the slopes, rocks and dry river based canyon, markers 526 on each side of the canyon, green 528 and hole 530.

Figure 7:
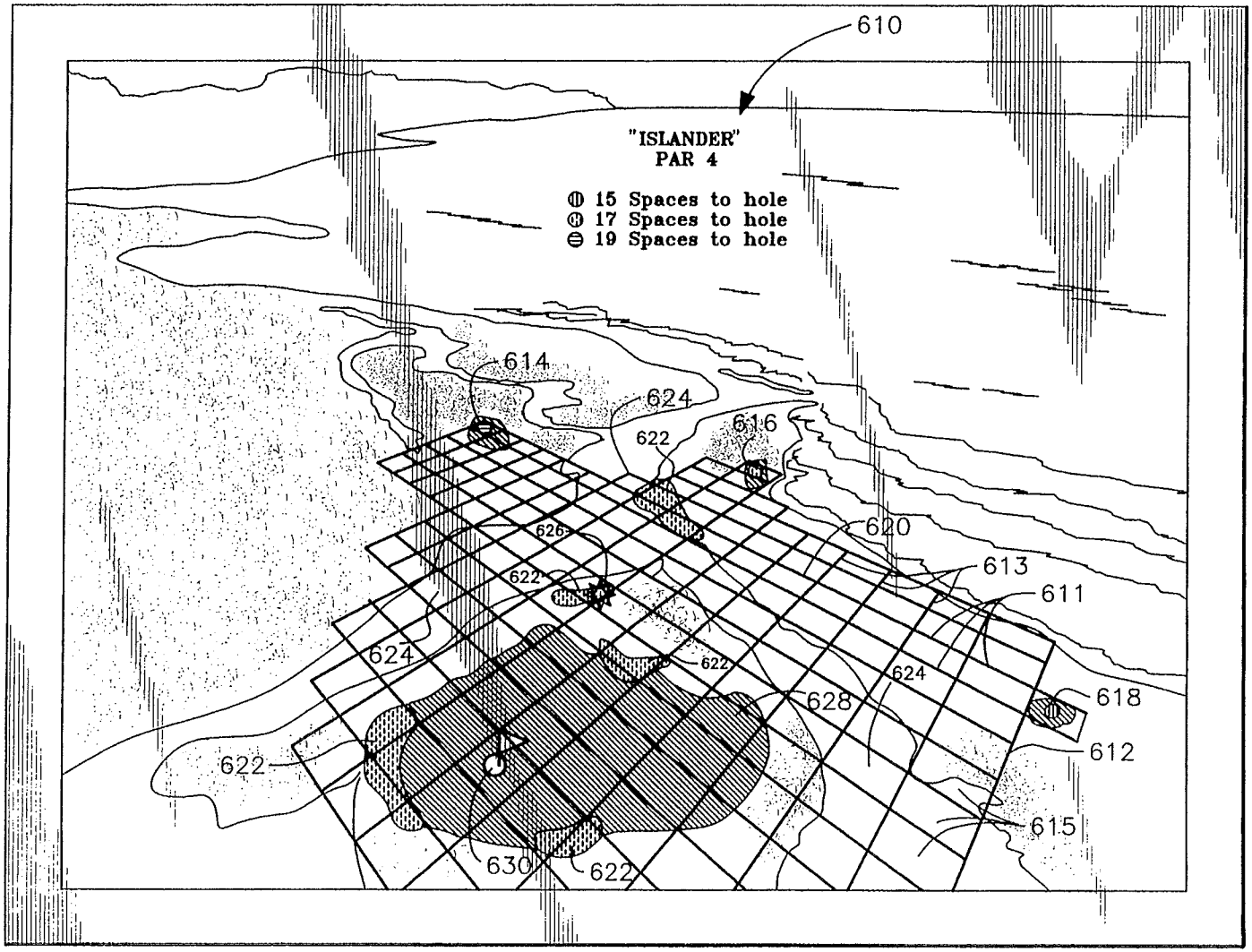
FIG. 7 is perspective view of an "Islander" par 4 hole.

As seen in FIG. 7, the par 4 "Islander" scene 610 depicts the playing area includes sections of three islands created along the shore front of a large body of water as viewed from above. The perspective grid pattern 612 overlaps the sections of the three islands showing professional tee position 614 set on one island and separated normal tee position 616 and advantage tee position 618 set at each end of the second island which is exposed to the open water. The blocks of the perspective grid pattern 612 gradually increase in size from the tee positions towards the green. The grid pattern forms quadrilateral blocks 715 by longitudinal lines 711 and transverse lines 713. The fairway 620 encompasses sections of the three islands including sand trap 622, bodies of water 624 and marker 626. Shown on the third island are sand traps 622, green 628 and hole 630.

Figure 8:
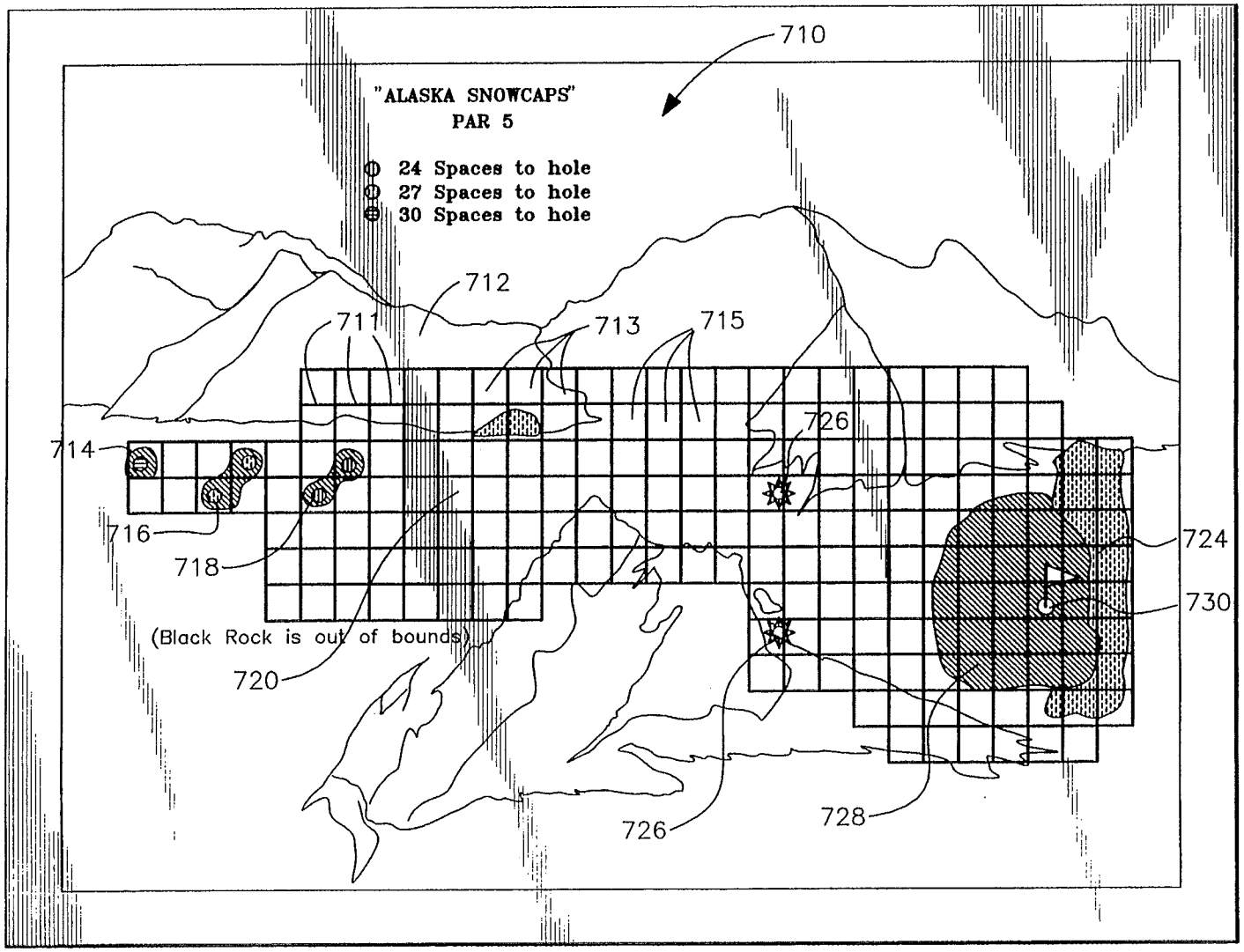
FIG. 8 is perspective view of an "Alaska Snowcaps" par 5 hole.

Shown in FIG. 8 is the par 5 "Alaska Snowcaps" scene 710 playing area set in the mountainous snow straddling the mountain tops. The perspective grid pattern 712 encompasses the snow bound mountainous terrain showing professional tee position 714 the grid pattern forms quadrilateral blocks 815 by longitudinal lines 811 and transverse lines 813 normal tee position 716 and advantage tee position 718, fairway 720 extending onto the slopes and mountain top, sand trap 722, mountainous slopes and peaks 724, markers 726, green 728 and hole 730. The blocks of the perspective grid 712 do not change in size because of being closely viewed from directly above.

Figure 9:
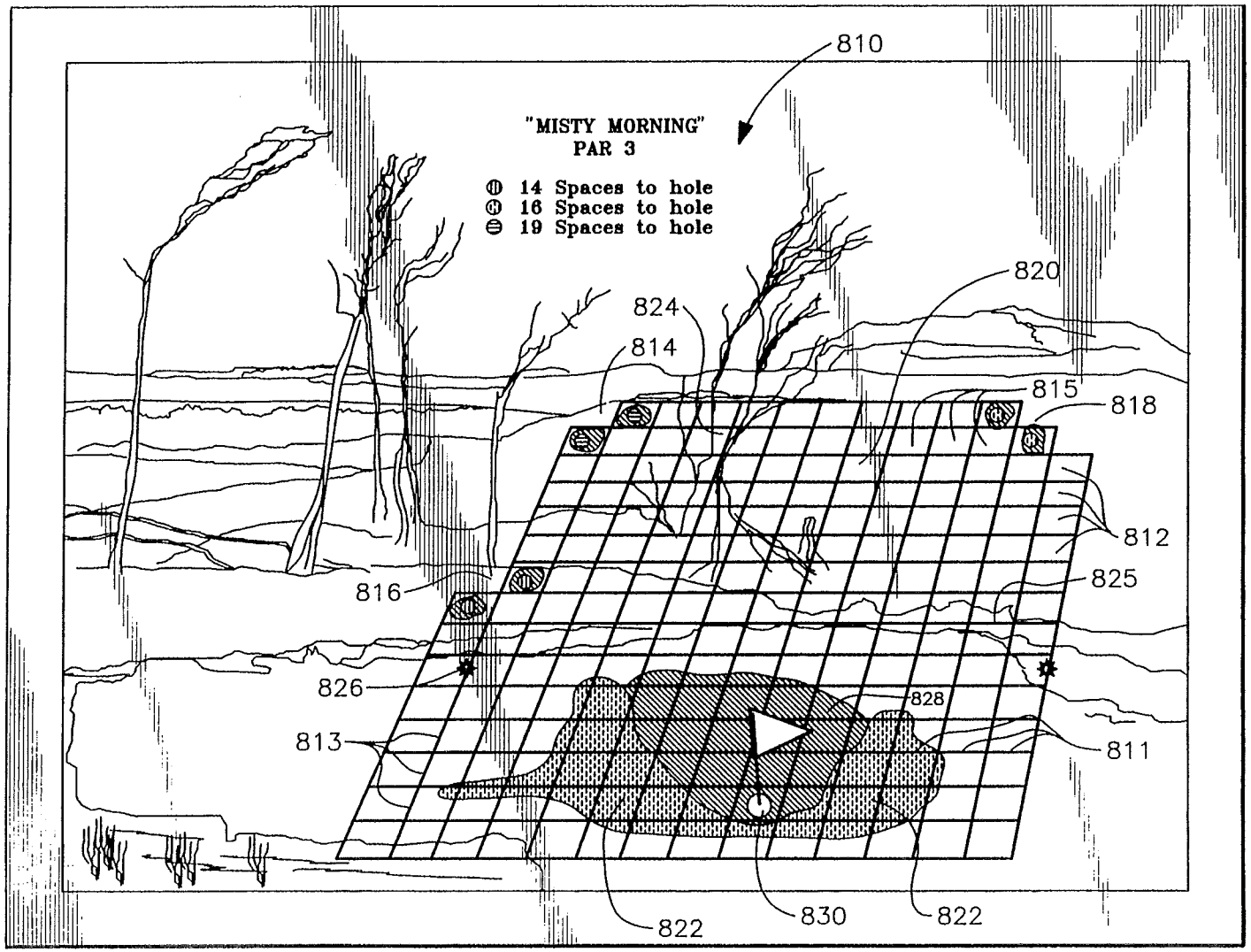
FIG. 9 is a perspective view of a "Misty Morning" par 3 hole.

FIG. 9 depicts the par 3 "Misty Morning" scene 810 playing area set in marsh land infested with shrinking trees, as viewed from above the ground level. The perspective grid pattern 812 is shown overlapping gullies and felled tree branches. The grid pattern forms quadrilateral blocks 915 by longitudinal lines 911 and transverse lines 913. Shown are the professional tee 814, normal tee 816 and advantage tee 818, fairway 820 sand traps 822, trees 824, gullies 825, markers 826, green 828 and hole 830. The blocks of the perspective grid 812 gradually increase from the tee positions towards the green.

The dimensions of the game boards as shown in FIGS. 1–9 usually are about seventeen inches by eleven inches in order to bring, in the full effect of the depth and realism of the scenery. Usually, the scene is a photograph thereof laminated with a clear coating. Other forms of duplicating the non-golf scene such as a painting are also applicable.

Figure 10:
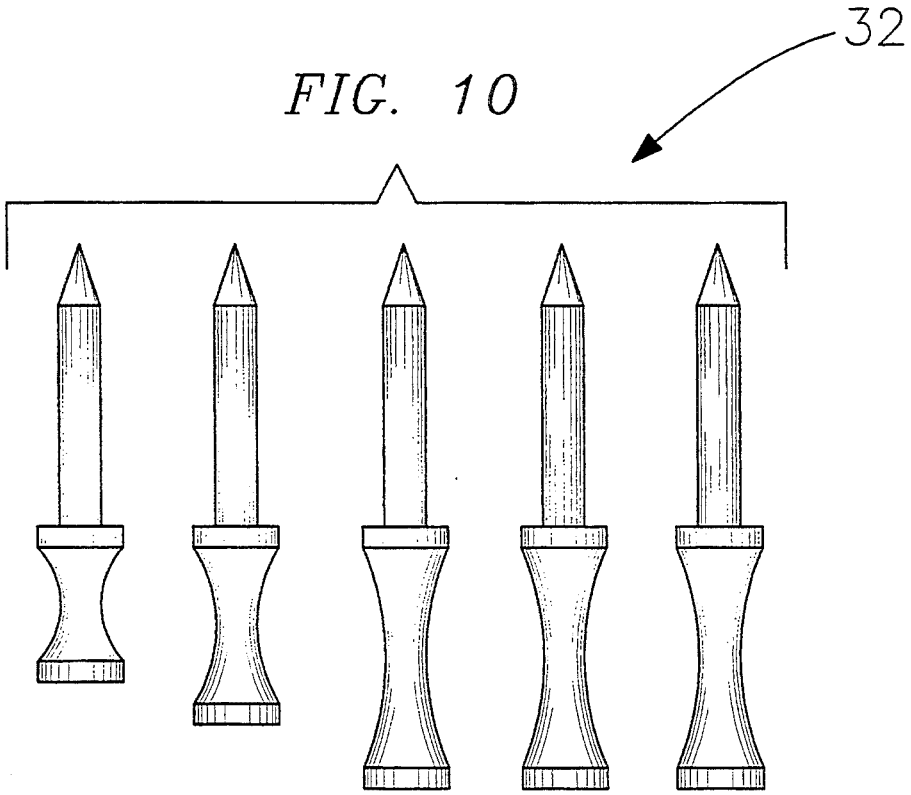
FIG. 10 is a perspective view of tee-shaped playing pieces.

The devices used in playing the present game include playing pieces, dice and cards. There are five playing pieces representing the golf ball as seen in FIG. 10. The playing pieces resemble golf tees and are used to mark the position of the golf ball on the, grid pattern.

Figure 11:
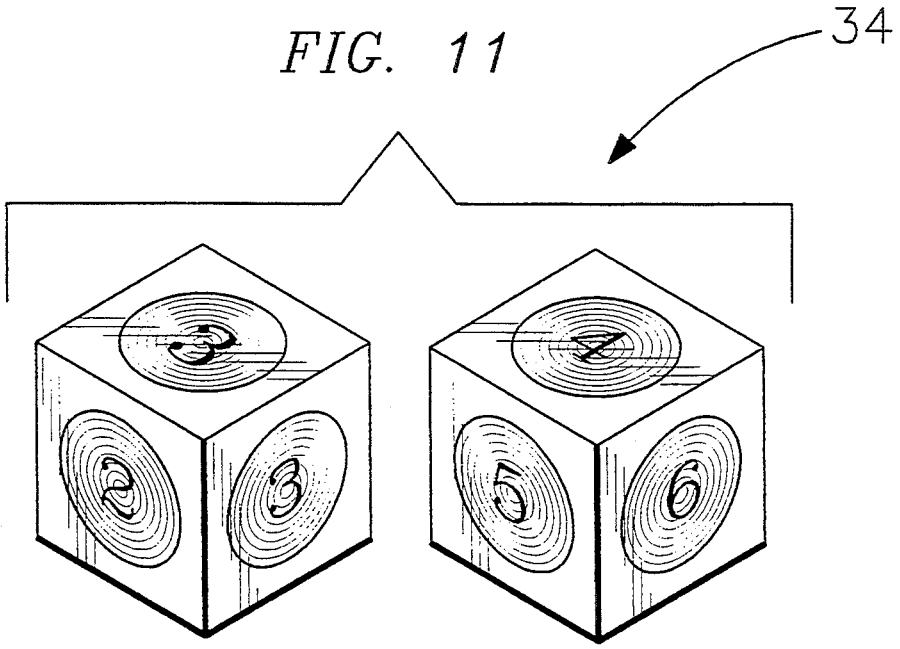
FIG. 11 is a front and back perspective view of a numbered fairway-die having numbers 2 to 6.
Figure 12:
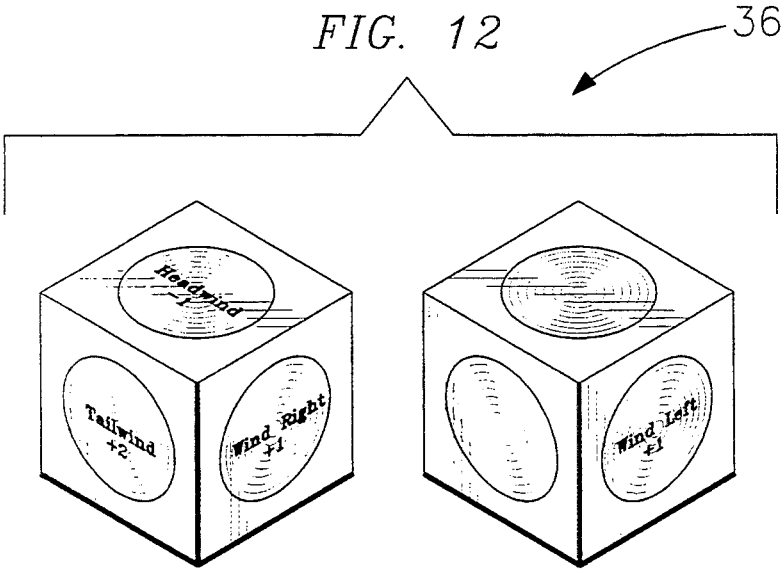
FIG. 12 is a front and back perspective view of a weather conditions fairway-die.
Figure 13:
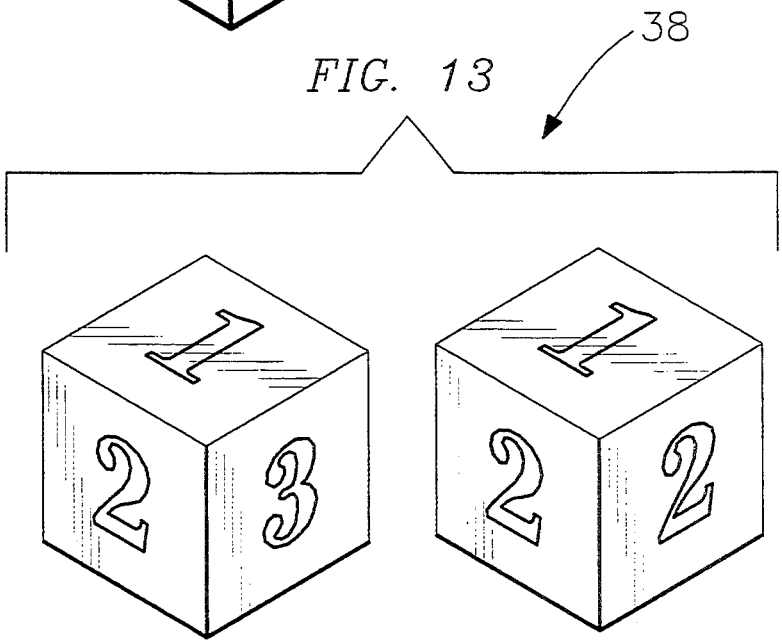
FIG. 13 is a front and back perspective view of a numbered green-die having numbers 1 to 3.

The dice are uniquely designed with colors, numbers, words and symbols which relate to numerical distance and weather conditions. Unique combinations of the dice and cards are used when teeing off, on the fairway and on the green. Shown in FIG. 11 is a fairway die having numerals two to six. FIG. 12 shows a weather conditions die and FIG. 13 shows die having numerals one to three for playing on the green.

There are two types of cards for playing the game skill cards and pro skill cards. Skill cards affect the direction of the shot and the club used. Pro-skill cards are used to prevent certain penalties on each hole. There are 36 skill cards which include the following:

| Number of cards | Use |
|---|---|
| 8 | "Putter" (Add or subtract up to two spaces to roll) |
| 2 | "Hook" (And three spaces diagonally at end of roll to left) |
| 2 | "Slice" (Add three spaces diagonally at end of roll to right) |
| 2 | "Closed Clubface" (Move one space left) |
| 2 | "Open Clubface" (Move one space right) |
| 4 | "Mulligan" (Cancel first roll. Use second roll and draw again) |
| 3 | "Stance Correction Right" (Move two spaces right) |
| 3 | "Stance Correction Left" (Move two spaces left) |
| 2 | "Chipping Iron" (Add or subtract one space) |
| 3 | "Wood Driver" (Add two spaces) |
| 3 | "Iron Driver" (Add or subtract two spaces) |
| 2 | "Break" (Add one space diagonally if desired at end) |
| There are six pro-skill cards as follows: | |
| 1 | "No Tailwind" (Unless desired) |
| 1 | "No Headwind" (Unless desired) |
| 1 | "No Sand trap Penalty" (Unless desired) |
| 1 | "No Wind Left" (Unless desired) |
| 1 | "No Wind Right" (Unless desired) |
| 1 | "No Water/Rock Penalty" (Unless desired) |

In playing the game, there are five different colored golf tee playing pieces 32 shown in FIG. 10 to be used per hole. Up to five single players, or five teams of two players each per team, or any combination of single player or team players can play. A single player will be referred to hereinafter in describing the game play which will also be applicable to a team or combination thereof. Each player selects one of the five different colored playing pieces 32 to begin play on the first hole which can be the "Alaska Snowcaps" hole in FIG. 8 or any of the other holes in FIGS. 1–9 to which the players agree. For the following discussion, the "Alaska Snowcaps" hole in FIG. 8 will be used to demonstrate the play.

The order of the players playing can be clockwise and determined initially by rolling a die with the lowest number going first. The lowest score from the previous hole then goes first on each succeeding hole.

Four cards from a combined skill pro skill pile of cards are dealt to each player. The tee-off positions as seen in FIG. 8 are Yellow-normal tee position 16, Red-advantage tee position 18 and Blue-professional position 14. The advantage tee position 18 can only be played if doubles are rolled with two dice or when a numeral two is rolled when playing a single die when beginning at the normal tee position 16. The professional tee position 14 is optional if a player desires more challenge or mandatory if a player is qualifying for the "Pro" status. In playing, the professional tee position 14 can be moved up to the normal position 16 if doubles are rolled or numeral two is rolled when playing a single die. The golf tee playing piece 32 must be in position before rolling the die or dice or a penalty loss of two spaces will be assessed.

The players have the option of moving playing piece 32 in the blocks of the perspective grid pattern 12 in either a horizontal direction or a vertical direction but is not permitted to mix the move both horizontally and vertically. Diagonal moves are allowed only when permitted by a die or a skill card which is always at the end of the move. The play is never permitted to go away from hole 30 unless penalties apply.

There are five dice involved as shown in FIGS. 11,12,13 and 14. Two white dice, the front of back view of the die 34 as seen in FIG. 11 containing numerals two to six is used on the fairway 20. The player is given the option only at the tee-off position of each hole choosing to use one or two white dice 34 and is limited thereafter to one white die for the remainder of that hole. The white dice 34 control the movement of playing piece 32 up to the green 28 and are used only until play reaches the green. The playing piece 32 can move only in one direction per move either straight ahead or laterally to the left or right within the blocks of the grid pattern. One darkly colored green die 36, the front and back view, as seen in FIG. 12 represents weather conditions on the fairway 20. The weather conditions indicia on die 36 include wind left-moves the playing piece 32 one block to the left; wind right-moves one block the right; headwind-subtracts one block; and tailwind-adds three blocks. Die 36 must always be used with the choice of one or two fairway white dice 34 until play reaches the green.

Figure 14:
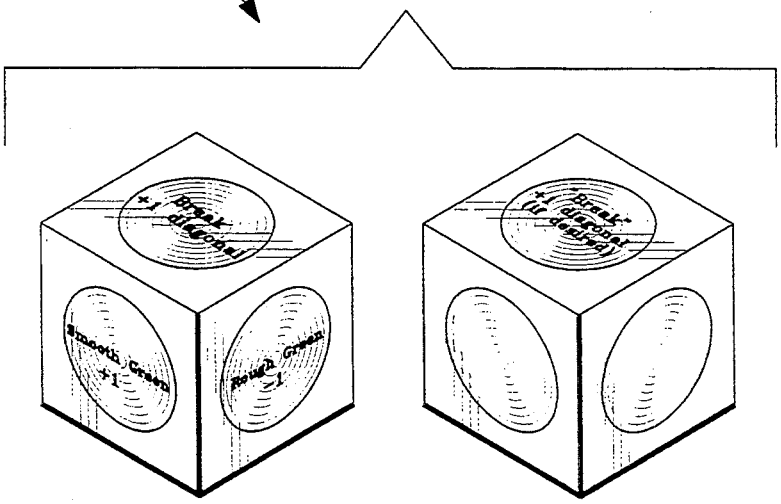
FIG. 14 is a front and back perspective view of a playing conditions green-die.

The lightly colored green numeral die 38 is only used on the green 28. Numeral die 38, the front and back view as seen in FIG. 13, contains numerals 1,2 and 3 to controls the movement of the playing piece on the green 28. Lightly colored green playing conditions die 40, the front and back view as seen in FIG. 14, is also used only on the green 28 along with die 38. The playing conditions indicia on lightly colored green die 40 include an option of: a break-to move diagonally one block; smooth green-add one block; and rough green-subtract on block. The putter card can only be used for play on the green If a grid pattern block encompasses even the slightest portion of the green 28, then the play must be considered as on the green 28. This rule takes priority over penalties as discussed below resulting from sand, water or rock being present in the grid pattern block. The putter card can only be used for play on the green 28.

The pile of the combined skill/pro skill cards contains forty two cards. After distributing four cards to each player, one card must be played after rolling dice 34. The card is played either onto a discard pile of cards, or if it is a pro-skill card then it is displayed in its pile in front of the player. The player has the option of either playing a card which helps move the playing piece or of discarding the card without performing the move. One card must be drawn before the next player draws a card. Failure to do so causes the player to be "handicapped" until the next hole by being short one playing card. Verbal warnings to the player to draw a card are not permitted. All forty two cards are reshuffled into one pile at the end of each hole to start play on the next hole.

A score card is provided to mark with a straight line in the appropriate box before each move or stroke. The total number of lines at the end of each hole determines the score to be written in. There is a maximum of nine strokes on each hole. An objective of strokes of "Par" is indicated next to the name of each hole.

Specially placed markers 26 on the fairway 20 designate about three quarters of the distance to the hole 30. The wood driver card and the iron driver card are to be used up to the marker 26. The chipping iron card is only used from the markers up to the green 28.

Penalties are encountered when the playing piece 32 is placed on a grid pattern block encompassing any portion of a penalized area during play.

Examples of penalties are: The playing piece 32 landing on water or rock formation results in a two stroke penalty, For the next move, the playing piece 32 is played in the nearest block beyond the penalty area closest to the hole 30.

Out of bounds results from playing piece 32 landing outside the grid pattern 12 which is a two stroke penalty. The playing piece is placed on the nearest block beyond the out of bounds area closest to the hole 30.

Landing in a sand trap results in the playing piece 32 being moved two blocks away from the hole 30 either horizontally, vertically or diagonally but not into another penalty area.

Landing in rough area which is designated by trees, shrubbery or designated areas results in the playing piece 32 being moved two blocks away from the hole 30 either horizontally, vertically or diagonally but not into another penalty area.

Landing in a block occupied by the playing piece 32 of an opponent results in the opponents playing piece 32 being moved up to two blocks towards the hole 30 either diagonally, vertically or horizontally.

A "power shot" of playing piece 32 is possible. This play is possible whenever there is a consecutive straight line of grid/block on both sides of missing area to allow rapid advancement over hazard area without the counting of missing grid/block spaces.

It is now apparent that the picture and the grid or blocks are integrally and strategically dependent upon one another to allow game to be visualized and played in a life-like scenic setting to avoid hazards and reach the hole with the least amount of strokes.

Having now described the invention, it will be apparent to one of ordinary skill in the art that many changes and modification can be made thereto without departing from the spirit and scope of the invention as set forth herein.

SCENIC T.G.A. TOUR"-OFFICIAL RULES

1. Choose one of five Golf "Tees" to be used as a playing piece. (five per hole maximum)

2. Four cards are dealt to each player.

3. Determine who will begin by rolling one die. Lowest number goes first. Play in a clockwise direction. Lowest score from previous hole(s) begins each new hole.

4. Beginning positions:

Yellow-normal "intermediate" level

Red-"Advantage" position which can only be played if doubles are rolled, or a number two is rolled if playing a single die, when beginning off the position.

Blue-"Professional" is optional if player desires a little more challenge, or is mandatory if trying to qualify for the "Pro" status. Blue can also move up one level to yellow, if doubles are rolled, or a number two is rolled if playing a single die.

* Tee must be placed in position before rolling, or loose two spaces as a penalty.

5. Five Dice:

Choose one or two white "Fairway dice" to begin. Option is only available off the "Tee" of two dice one white die can only be used thereafter. The number one has been eliminated from these dice to give more distance to move. Use until play ends on the "Green".

One-Dark Green die represents weather conditions on the "Fairway". (Wind Left-one space left, Wind Right-one space right, Headwind-subtract one space, or Tailwind-add three spaces). This die must always be used with the choice of one or tow white "Fairway" dice until play touches "Green".

One-Light Green numbered die is only to be used when play begins on the "Green". Has numbers lower than four on it to slow down distance to move.

One-Light Green die represents playing conditions on the "Green". (Break-one space diagonally if desired, Smooth Green-add one space, Rough Green-subtract one space) This die must be used while on the "Green".

6. Playing of Cards: (Total of 42 "Skill/Pro Skill" cards)

One of four cards must be played after rolling in one of two places: On the Discard Pile, or "Pro Skill" cards should be displayed in front of player(s).

*All cards will be re-shuffled at the end of each hole whether discarded, displayed in front of player(s), or unused cards.

*Player has option of using card to help move, or discarding without any effect on move.

7. Loss of card

One card must be drawn before next player draws, or be "handicapped" until next hole by being short one playing card.

*Verbal warnings are not allowed.

8. "Score Card"

Mark with a straight line in the appropriate box before each move (or stroke).

Total the number of lines at the end of each hole and write in the score. *There is a nine stroke maximum on each hole.

9. Specially placed trees on "Fairway", designate three-fourths of the way to hole. *Wood Driver Card" cannot be used thereafter *Iron Driver Card" cannot be used thereafter *"Chipping Iron Card" can only be used thereafter 10. "Green"-area which is light green immediately around flag.

If space contains even the slightest amount of light green (Green), play is considered on the "Green". *Prioritizes in importance over "Sand,Water, and Rock" penalties.

"Putter Card" can only be used here if play beings on the "Green".

11. "Water/Rock Hazard" is a two stroke penalty if play touches. (Play nearest block beyond penalty area closest to the hole)

12. "Out of Bounds"-designated by absence of grid, is a two stroke penalty. (Play nearest edge closest to flag following turn).

13. "Sand Trap"-If space contains slightest amount of "Sand Trap", move two spaces away from flag (horizontally,vertically, or diagonally) but never into other Penalty area!

*Prioritizes in importance over "Water or Rock" penalty

*Option "Sand Trap Adjoining Green" choose 2 green die or 2 fairway die following penalty 14. "Rough Area"-designated by white markers along border or if play touches trees. Move two spaces away from flag (horizontally,vertically, or diagonally) but never into other Penalty area!

15. "Fore"-is the warning word if you are about to land on the space of an opponent. Opponent must move up to two spaces (diagonally,vertically or horizontally) towards flag. (Penalties never apply)

16. Direction of Move-can either be horizontal or vertical which ever player chooses, but never a mixture of both when moving numbers on die/dice and/or cards.

*Diagonal moves can only be played when given option on die or noted on "Skill Cards", always at end of play

*Play must always follow a natural direction forward or sideways never backward!

17. "Power Shot"-Grid/block is sometimes removed from consecutive line of other grid/block to allow a "power shot" or rapid advancement over hazard area without the counting of missing grid/block spaces.

18. Controversial Play-If play is in question, vote of majority rules.

19. Winner! player(s) with lowest score or to achieve a score of "Par" or less.

"Sudden Death"-Play-off option in case of a "Tie" (same score). Player with lowest roll of one die chooses hole and begins first. Lowest score on hole wins. Continue to next chosen hole is necessary.

20. Length of Time-Each hole take approximately eight to twelve minutes.

"Short Game"-three holes (Par 3,4 and 5) approximately thirty minutes.

"Full Game"-nine holes approximately two hours.

21. "Pro Scenic T.G.A. Tour" Player-is a player who achieves a "Par" score three times starting at the yellow "Intermediate" tee off position, and then finally qualifies by achieving a "Par" score from the blue "Professional" tee position. (Does not need to be consecutively).

22. "Tournaments" can be played by achieving the lowest total score of three games of nine holes each.

23. "Pro Tournaments" can only be played by "Pro" qualified players, who begin nine holes for three games at the "Professional" tee starting position.

24. Golf Terminology:

"Eagle"-two under Par

"Birdie"-one under Par

"Bogey"-one over Par

"Double Bogey"-two over Par

"Par"-number of plays or strokes used as objective for each hole

25. "Teams"-for up to ten players per hole. (Five playing pieces per hole maximum) Consists of:

Two players who can play on the same hole as "single" players.

Lowest roll of one die determines who will have first choice to roll for hole.

Blue "Professional" tee position is mandatory unless player rolls doubles or the number two is rolled if playing a single die off tee.

Four Cards will be displayed between partners, who must sit next to each other.

Option to "Pass Roll" to other partner which cancels roll. If this option is exercised, team cannot draw a card that turn. (They play card, but cannot draw). Four cards will begin each new hole.

Rotation of each play between partners, ensures equal opportunity of rolling and card playing (unless a "Mulligan" card is used).

Partners can be switched during a "Tournament".

Pro Scenic T.G.A. Tour" players cannot qualify for Title or certificate as a "team".

All other rules apply as in single playing.

26. Large Groups-up to 30 can play by giving three holes to each group of up to 10, and rotate in a clockwise direction three times, or one hole to each group and rotate three times for a "short" game. (Send for 3 additional sets of Cards, Dice and playing pieces).

What is claimed is:

1. A golf game apparatus comprising a plurality of game boards, each game board having a different golf hole playing area comprising at least one tee position, a fairway and a green, each playing area set within a different overlapping scenic setting, said overlapping scenic setting encompassing the game board, a perspective grid pattern encompassing each playing area, said grid pattern comprised of intersecting longitudinal and transverse straight lines forming quadrilateral blocks gradually changing in size relative to the perspective distance of the scenic setting and playing area, said perspective grid pattern providing a playing surface for said golf game on said playing area within said scenic setting, a plurality of playing pieces which move on said blocks of said perspective grid pattern, chance devices used on the tee position and on the fairway comprise a combination of dice at least one die having numerical indicia and a second die having weather conditions indicia and a card with indicia affecting the direction of the shot and club used, chance devices used on the green comprise a combination of different dice one die for numerical indicia and one die for playing conditions indicia and a card for affecting the length of the putt.

2. A golf game according to claim 1 wherein said scenic setting comprises a cliff plateau.

3. A golf game according to claim 1 wherein said scenic setting comprises a mountain view.

4. A golf game according to claim 1 wherein said scenic setting comprises snow capped mountains.

5. A golf game according to claim 1 wherein said scenic setting comprises a majestic meadow.

6. A golf game according to claim 1 wherein said scenic setting comprises a lakeside prairie.

7. A golf game according to claim 1 wherein said scenic setting comprises a dry river gulch.

8. A golf game according to claim 1 wherein said scenic setting comprises an island.

9. A golf game according to claim 1 wherein said scenic setting comprises a rainbow at a ravine.

10. A golf game according to claim 1 wherein said scenic setting comprises a misty morning.

11. A golf game according to claim 1 wherein the die having numerical indicia for the fairway includes numbers two to six.

12. A golf game according to claim 11 wherein the die having weather conditions indicia for the fairway comprise wind conditions.

13. A golf game according to claim 12 wherein the cards having indicia for the fairway comprise indicia relative to the position of the players stance and the position of the clubface.

14. A golf game according to claim 13 wherein the die having numerical indicia for the green comprises numbers one, two and three.

15. A golf game according to claim 14 wherein the die having playing conditions indicia for the green comprise surface conditions of the green.

16. A golf game according to claim 15 comprising forty two cards having indicia for playing the game.

17. A golf game according to claim 16 wherein thirty six cards have indicia which affect the direction of the movement of the playing piece and the club used.

18. A golf game according to claim 17 wherein the remaining six cards have indicia which relate to penalities.

19. A golf game according to claim 1 wherein the dimensions of the game boards are about seventeen inches long by about eleven inches wide.

* * * * *